73-664
10/7/86 XR 4,615,375 SR

United States Patent [19]
Bower et al.

[11] Patent Number: 4,615,375
[45] Date of Patent: Oct. 7, 1986

[54] CONTINUOUS CASTING MOLD FRICTION MONITOR

[75] Inventors: John E. Bower; Ronald S. Vranka, both of Monroeville; Mark H. Mahler, Pittsburgh, all of Pa.

[73] Assignee: United States Steel Corporation, Pittsburgh, Pa.

[21] Appl. No.: 722,589

[22] Filed: Apr. 12, 1985

Related U.S. Application Data

[63] Continuation-in-part of Ser. No. 483,401, Apr. 18, 1983, abandoned.

[51] Int. Cl.[4] ..... B22D 11/16
[52] U.S. Cl. ..... 164/451; 164/150; 164/416; 164/454; 73/664
[58] Field of Search ..... 164/4.1, 150, 154, 413, 164/416, 451, 452, 453, 454, 478; 73/664

[56] References Cited

U.S. PATENT DOCUMENTS

| | | | |
|---|---|---|---|
| 3,557,865 | 1/1971 | Gallucci et al. | 164/4.1 |
| 3,893,502 | 7/1975 | Slamar | 164/4.1 |
| 4,532,975 | 8/1985 | Ives | 164/150 |

FOREIGN PATENT DOCUMENTS

| | | | |
|---|---|---|---|
| 57-32866 | 2/1982 | Japan | 164/150 |
| 1556616 | 11/1979 | United Kingdom . | |
| 0925539 | 5/1982 | U.S.S.R. | 164/150 |

OTHER PUBLICATIONS

E.P. 44,291–Abstract, published 9/15/1981.

*Primary Examiner*—Nicholas P. Godici
*Assistant Examiner*—Richard K. Seidel
*Attorney, Agent, or Firm*—William F. Riesmeyer, III

[57] ABSTRACT

A load signal representing the load between a mold and an oscillating mechanism is separated into its static offset and dynamic components. The static offset signal is compared with a free-running static offset to obtain a substantially DC signal representing the DC component of mold friction. A DC voltage is generated corresponding to the RMS value of the dynamic load signal component, and a reference voltage corresponding to the RMS value of the dynamic signal component of a free-running load signal is subtracted in order to obtain a substantially DC signal representing the dynamic component of mold friction.

52 Claims, 6 Drawing Figures

CONTINUOUS CASTING MOLD FRICTION MONITOR

This is a continuation-in-part of U.S. patent application Ser. No. 483,401, filed Apr. 18, 1983, now abandoned.

BACKGROUND OF THE INVENTION

This invention relates to continuous casting systems, and more particularly to such a system in which the mold is oscillated during casting. Still more particularly, the invention is directed to a method and apparatus for monitoring the friction between the mold and the mold contents during oscillation of the mold.

In a conventional continuous casting system, a plug or "dummy bar" is inserted through the bottom of an open-bottomed mold, and molten metal is then poured into the mold. The mold sidewalls are typically water-cooled, and the molten metal cools significantly faster around the periphery of the mold. As the metal begins to harden, a skin develops around its periphery and the plug is slowly withdrawn from the bottom of the mold. As the strand is withdrawn from the bottom of the mold, molten metal is continuously poured into the top of the mold, and a long strand of casting can be obtained from a relatively small mold.

In order to insure that the skin does not adhere to the mold surface, the mold is typically oscillated in a vertical direction at a relatively low frequency, e.g. 3 Hz. The mold is also typically coated with a flux or oil to decrease as much as possible the friction between the strand and mold. Despite these friction-reducing measures, it is still possible for the skin to adhere to the mold surfaces. This will result in a degradation of the surface of the cast product, and worse, may result in a "break-out" where the skin tears and the internal molten metal escapes as the strand is pulled out of the bottom of the mold. It is therefore imperative that the friction between the mold and skin be closely monitored.

The simplest method of monitored the friction between the mold and casting skin is to monitor the load on the mold oscillating mechanism, and a number of such techniques have been developed. Grenfell, in his British Patent Specification No. 1,556,616, discloses an arrangement wherein load transducers are provided between the mold and the support table to weigh the mold so that both the static weight of the mold and the apparent weight of the mold during withdrawal of the strand can be determined and utilized to establish the frictional force. In the Grenfell monitoring system, the waveform of the load signal is compared with a reference waveform developed during a previous casting operation, and corrective action is taken whenever the present waveform exceeds the reference waveform in either direction. The Grenfell system can be unsatisfactory in that factors other than the mold friction may cause transients in the load signal, and these transients will exceed the reference waveform and result in an erroneous diagnosis of a high friction condition. Further, the waveform monitored by Grenfell is the total load waveform consisting of both a static offset portion and a dynamic portion. If some change occurs in the static offset portion and thereby raises or lowers the overall level of the load signal, a high friction condition may be diagnosed even though no such condition has occurred.

Another monitored technique is disclosed in European Pat. No. 44-291. In this system, a load cell is located at each of the four corners of the mold table and the outputs of the four load cells are summed to obtain a total force signal. The static weight of the mold is then effectively subtracted from the total force signal by zeroing the system at rest, and an accelerometer-generated signal allegedly corresponding to the dynamic mass of the mold is then further subtracted. The final result is a signal roughly indicative of the friction between the casting and mold sidewalls. This final signal is then monitored to determine when a high friction condition occurs.

The system described in the European Patent suffers from disadvantages similar to those in the Grenfell system. Transients occurring in the load cell outputs, which transients may not be due to friction between the mold and strand, will be passed through to the final signal and will result in erroneous diagnosis of an excessive friction condition. Further, conditions other than mold friction may change during the casting operation to raise or lower the overall level of the load signal. The raising or lowering of the overall level of the load signal, as opposed to the level of merely the dynamic portion of that load signal, cannot be distinguished in the European Patent system.

A still further friction monitoring technique is disclosed in U.S. Pat. No. 3,893,502 to Slamar. According to the Slamar technique, the armature current of the motor used to oscillate the mold is monitored. The armature current is integrated to average the current value over some predetermined interval, and from this average value is subtracted a substantially DC signal indicating the average current value during free-running operation (i.e. during oscillation of an empty mold). The difference will then indicate the amount of the load signal which is due solely to mold friction.

Due to its integration of the armature current, the Slamar technique will be less prone to transient-caused errors than the systems described above. However, it is similar to the above-described system in its inability to differentiate between changes which occur in the overall level of the load signal and those which occur in the dynamic portion of the signal.

While the overall load signal, including both the static and dynamic portions thereof, is important in monitoring the mold friction, there are some instances where it would be highly desirable to be able to distinguish between changes which occur in the static offset portion of the signal and changes which occur in the dynamic portion of the signal. For example, this may be particularly important in determining the effects of certain operating parameters on the mold friction, such as the composition and/or quantity of the mold flux or oil, the liquid level within the mold, the oscillator speed and stroke, and the degree of mold taper. The above-described systems will all be severely limited in their respective abilities to provide accurate information as to the precise effect which the changing of any one or more of these factors may cause.

SUMMARY OF THE INVENTION

It is therefore an object of the present invention to provide an improved mold friction monitoring device which is capable of distinguishing between changes in the static and dynamic components of mold friction.

It is a further object of this invention to provide such a system in which the dynamic component of mold friction can be displayed to the system operator in an easily readable form.

Briefly, these and other objects are achieved according to the present invention by receiving signals from a plurality of load cells and combining these signals to obtain a total load signal which includes both a static offset, or DC, component and a dynamic, or AC, component. The DC component is extracted from the load signal, e.g. by filtering, and the extracted static offset component is supplied together with the original load signal to a subtractor which substracts the static offset component from the load signal to obtain the dynamic component of the load signal. This dynamic component is then provided through an RMS-to-voltage converter which generates a DC voltage corresponding to the RMS value of the dynamic signal. A DC reference signal corresponding to the RMS value of the free-running mold oscillator, i.e. an oscillating empty mold, is subtracted from the DC-dynamic signal to obtain a DC voltage corresponding to the portion of the dynamic load signal attributable to mold friction. This can then be displayed on a digital panel meter and can also be monitored and an alarm signal generated when the displayed value becomes excessive.

The extracted static offset component of the total load signal is also provided to a second subtractor where the free-running static offset load signal is subtracted. The result is a signal representing the portion of the static offset load signal attributable to mold friction. This value can similarly be displayed on a digital panel meter and monitored for an excessive friction condition.

According to another embodiment of the invention, there is provided an improved mold friction monitoring device which employs the above-mentioned extracted static offset component of the load signal. This component, corresponding to the mean oscillator load during casting, is amplified with one gain to determine the peak-to-peak mold friction force, and with a second gain related to the first, to determine the maximum mold friction force. Both of these gains depend on the extent of motion of an oscillator mechanism during oscillation (i.e., oscillator stroke), the frequency of oscillation and the rate at which extraction occurs (i.e. casting speed).

The free-running static and dynamic reference signals can be previously determined and fixed throughout the casting operation, or can be variable in accordance with the oscillating speed. If variable, the reference signals could be generated by a manually adjustable reference signal generator which can be adjusted depending upon the oscillating speed being used, or a continuously and automatically variable reference signal generator can be used which will automatically generate the proper reference level in accordance with the detected oscillating speed.

BRIEF DESCRIPTION OF THE DRAWINGS

The invention will be more clearly understood from the following description in conjunction with the accompanying drawings, in which.

DETAILED DESCRIPTION OF THE PREFERRED EMBODIMENTS

Figure 1:
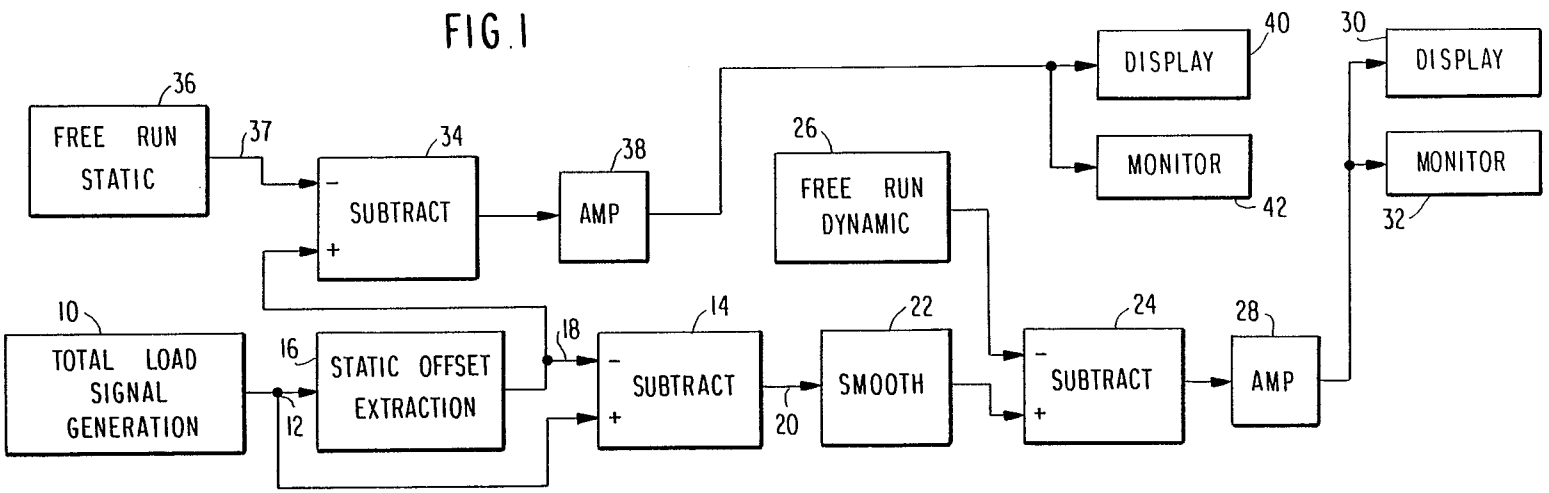
FIG. 1 is a block diagram of a mold friction monitoring system according to the present invention.

Referring now to FIG. 1, a block diagram of a mold friction monitoring system according to a first embodiment of the present invention is illustrated. The system includes total load signal generation circuitry 10 which generates a load signal corresponding to the total load on the oscillating mechanism during a casting operation. The generation of such a total load signal is very well known in the art, and the load signal generation circuitry may, for example, include a plurality of load cells each providing outputs through signal conditioner circuitry to a plurality of corresponding inputs of a summation amplifier which, in turn, will generate a single signal representing the total oscillator load. The load signal at line 12 is provided simultaneously to both the positive input of a subtraction circuit 14, which may be a simple operational amplifier, and to the input of a static offset extraction circuit 16 which may in its simplest form comprise a lowpass filter and is preferably an active filter.

Figure 5:
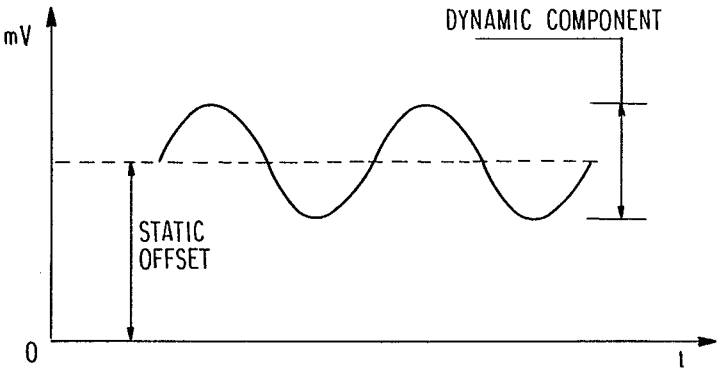
FIG. 5 is a waveform illustration of a hypothetical load signal.

The function of the static offset extraction circuit 16 can be more clearly understood with reference to FIG. 5 which illustrates a hypothetical idealized load signal obtained at the output 12 of the total load signal generation circuitry 10. It should be realized that the waveform of a typical load signal often will vary substantially from the ideal sine waveform. The load signal will include a dynamic, or AC, component superimposed on a DC, or static, offset component, and passing the load signal through a lowpass filter will result in a DC signal corresponding to the static offset component of the load signal. This static offset signal will be provided on line 18 to the negative input of the subtraction circuit 14 where it will be subtracted from the total load signal. The output on line 20 will therefore comprise only the dynamic, or AC, portion of the load signal in FIG. 5, and this will be provided to a smoothing circuit 22 which may, for example, generate a DC voltage corresponding to the RMS value of the dynamic signal on line 20. The smoothing circuit 22 may also include filters, e.g., for removing certain frequency components from the dynamic signal prior to generating the RMS-value signal.

The DC voltage obtained from the smoothing circuit 22 will be provided to the positive input of a second subtraction circuit 24, the negative input to which is provided by a signal generator 26 which generates a DC signal corresponding to the RMS value of the dynamic component of the load signal obtained during oscillation of an empty mold. By subtracting from the smoothing circuit output a signal corresponding to the free-running dynamic load, an output from the subtraction circuit 24 is obtained which represents the portion of the dynamic load signal which is attributable to mold friction. This signal is passed through an amplifier 28 to a display apparatus 30 which may be a digital panel meter. The substantially DC signal can also be provided to a monitoring device 32 which will sound an alarm when the signal exceeds some predetermined limit value.

In addition to monitoring the dynamic component of the mold friction, the system in FIG. 1 monitors the static component thereof, and for this reason the output on line 18 from the static offset extraction circuit 16 is also provided to the positive input of a third subtraction circuit 34. A DC voltage corresponding to the static offset component of the load signal obtained for a free-running mold is generated in a static reference signal generator 36 and is provided to the negative input of the subtraction circuit 34, so that the output from the subtraction circuit 34 will represent the amount of the static offset component of the load signal which is attributable to mold friction. This signal representing the static offset component of mold friction is provided through an amplifier 38 to a display 40 and a monitoring device 42 which may be similar to their counterparts 30 and 32, respectively, in the dynamic signal monitoring circuitry.

Figure 2:
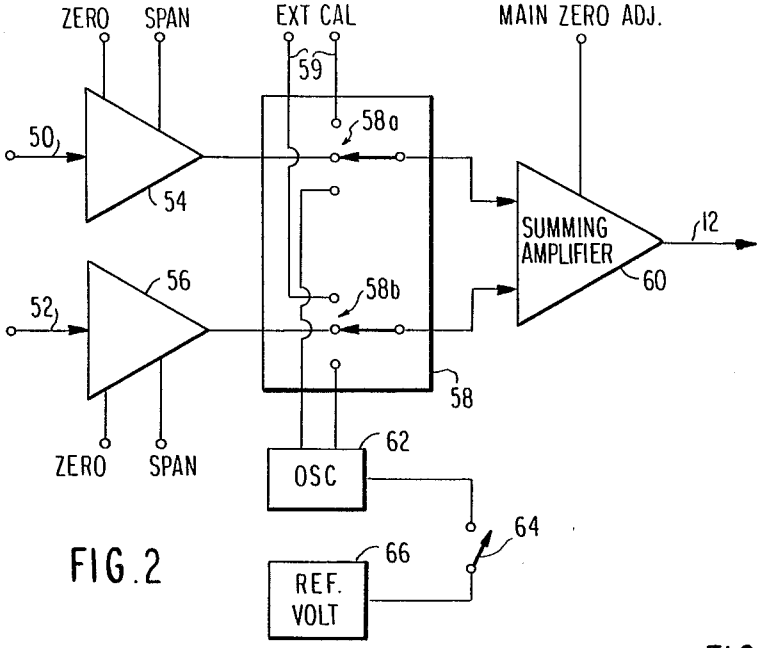
FIG. 2 is a diagram generally illustrating the configuration of the load signal generating circuitry of FIG. 1.

While the detailed configurations of the various components illustrated in FIG. 1 could take a variety of well-known forms, some examples will be described with reference to FIGS. 2–4. FIG. 2 illustrates a simple configuration for the load signal generation circuitry 10 in FIG. 1. A pair of signals on lines 50 and 52 from respective load cells are provided to signal conditioning amplifiers 54 and 56, respectively. Although two load cell inputs are illustrated, it should be clear that the present invention would be applicable to any system using one or more load cells, and in some instances four load cells may be employed, one at each corner of a mold table. In any event, the signal conditioning amplifiers provide regulated excitation, amplification and filtering to condition and calibrate the load cells to specific engineering units of pounds or kips force. Each of the amplifiers would preferably include independent zero and span controls that are externally mounted to facilitate calibration. The individually calibrated load signals from each amplifier would be routed via a calibration switch 58 to respective inputs of a summing amplifier 60 where they would be added together to derive the total instantaneous force of the oscillator system, i.e. the total load signal which is to be provided on line 12 to the static offset extraction circuit 16.

By placing the calibration switches 58*a* and 58*b* in their upper, or external, positions, the individual load cells, signal conditioning amplifiers and the free-running reference signal generator circuits would be disconnected from the remainder of the circuitry. Known dynamic, DC, and dynamic with superimposed DC voltages would be applied to the external inputs 59 utilizing well-known calibration equipment. The resulting values would be displayed on the static-offset load and dynamic digital panel display meters 40 and 30. The monitoring system could then be adjusted to proper specifications, with the adjustment normally being performed in a laboratory prior to installation but also being possible in the field if a problem was suspected.

By switching the switches 58*a* and 58*b* to their lower positions, an internally provided calibration circuit could provide dynamic, DC or dynamic with a superimposed DC voltage for checking the various functions of the unit. The calibration circuit would consist of a precision oscillator 62 having a particular frequency, and a precision voltage reference generator 66 for providing selected voltage levels. The oscillator frequency could be injected into the system to check the RMS conversion circuit, and the resulting value would be displayed on the RMS meter 30. With the oscillator 62 running, the selected voltage level from the precision voltage source 66 could be superimposed on the frequency, and the resulting value would be displayed on the static-offset load display meter 40. The calibration switch could be used to zero the amplifier 60 for both AC and DC signal components. After calibration, the switches 58*a* and 58*b* would be returned to their center positions to receive the outputs from the amplifiers 54 and 56, respectively.

The amplifier 60 would also preferably be provided with an external zero adjust so that the operator could achieve a zero condition for the combined forces prior to start of a casting operation.

The free-running static load signal generator 36 and free-running dynamic load signal generator 26 could take a variety of forms. The static and dynamic components of the free-running load signal will vary to some extent in accordance with the oscillating speed of the mold, and, if the oscillating speed of the mold is to be predetermined, the signal generators 26 and 36 could be fixed signal generators. Alternatively, if a number of discrete oscillating frequencies may be used, the signal generators 26 and 36 could be manually adjustable devices for selecting a DC voltage corresponding to the free-running static offset load at a desired oscillator speed. The voltages to be generated could be previously derived from a free-running trial operation of the mold. Such a circuit configuration is illustrated in FIG. 3, wherein a manually adjustable DC signal generator 70 generates a selected DC signal which is provided through an amplifier 72 to the output line 37, in the case of the free-running static load signal generator, or to the output line 27 in the case of the free-running dynamic load signal generator.

Figure 3:
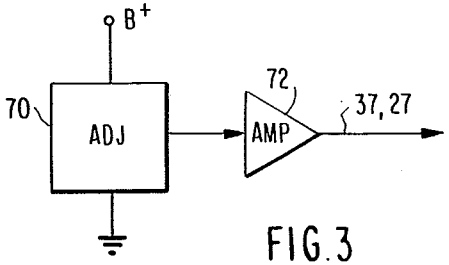
FIG. 3 is a brief diagram illustrating one example of a manually adjustable reference signal generator which may be used to generate the free-running reference signals in FIG. 1.

A drawback of the free-running reference signal generator configuration of FIG. 3 is that the signal generator must be manually adjusted to compensate for oscillator speed changes, and the adjustment must be made with reference to a curve or table determined during a previous free-running operation. A preferable arrangement which does not require manual adjustment would be an automatic free-running reference signal generator as illustrated in FIG. 4. The automatic signal generator of FIG. 4 would sense the mold oscillating frequency from a signal available at a suitable location, e.g. within the static offset extraction circuitry 16. This oscillating signal would be provided to a frequency-to-voltage converter 80 which would generate a DC output signal corresponding to the oscillating frequency of the mold. This DC signal representing the oscillating frequency of the mold would then be passed through a linearizer 82 and amplifier 84 to fit the static offset load slope of the equivalent free-running condition. As the oscillator would vary in speed, the oscillating frequency would be detected and would be used to dynamically adjust the free-running static offset signal to be supplied on line 37 to the negative input of the subtraction circuit 34.

Similarly, the oscillating signal would be provided through a second linearizer 86 and amplifier 88 to fit a previously-determined curve representing the RMS value of the dynamic load signal at various free-running frequencies, and the frequency-dependent free-running dynamic load signal component would be provided from the output of line 88 to the negative input of subtraction circuit 24.

The alarm limit monitoring devices 32 and 42 could be any one of a number of well-known types, and in the preferred embodiment could be digitally operated devices sensing the binary coded decimal (BCD) outputs of display meters 30 and 40, respectively. The alarm unit could be preset with a digitally coded switch to a particularly high level expressed in kips. In the event that the preset levels of the static offset and/or RMS loads were reached, a light or audible alarm would warn the operator. These preset levels could be changed as mold friction data is accumulated and the operator becomes more confident with expected values.

The friction monitoring system described above provides a significant advantage in its ability to specifically identify the dynamic component of mold friction. This permits more detailed analysis of the mold operation and the effects on the mold operation of changes in various operating conditions. In addition, the circuit components used in deriving the RMS dynamic signal component may preferably have a time constant which would effectively filter out very short-duration changes in the load in the casting operation. If this type of filtering characteristic is desired and the circuit components for generating the RMS signal level do not inherently provide it, an additional filter could be provided, for example in the output line 12 from the load signal generation circuit 10, to filter out the extraneous changes in the load signal.

Figure 4:
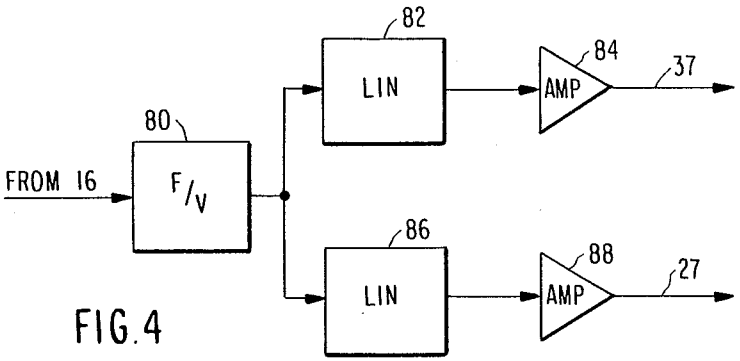
FIG. 4 is a brief diagram of one example of an automatic reference signal generator which may be used in the system of FIG. 1.

A further advantage of the system according to the present invention is the ability to automatically adjust its reference voltages in accordance with the circuitry illustrated in FIG. 4. This would enable effective operation during a casting where the oscillator speeds fluctuate continuously.

While the invention described in the first embodiment constitutes an improvement over the prior art insofar as this first embodiment is able to distinguish between static and dynamic components of a total load signal, it has been discovered recently that the relationship between the peak-to-peak oscillator forces and the mold friction force is nonlinear. As a result, linearly subtracting the output of signal generator 26 from the output of smoothing circuit 22, as described above with respect to the first embodiment, can result in inaccurate mold friction force measurements.

Figure 6:
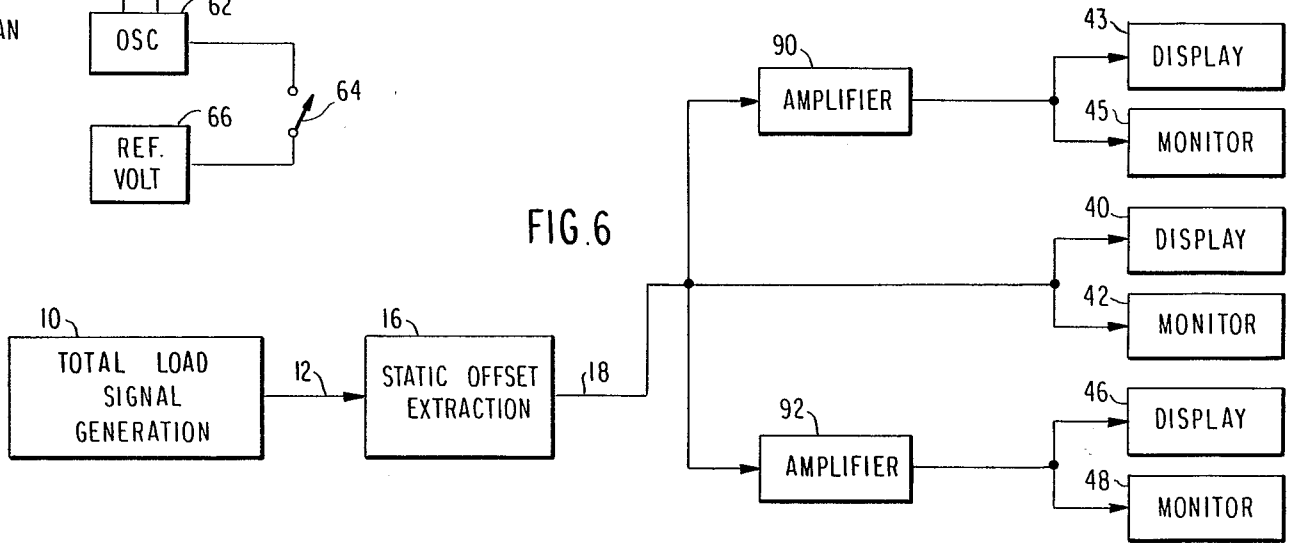
FIG. 6 is a block diagram of a mold friction monitoring system according to a second embodiment of the present invention.

A second embodiment of the invention, obviating the need to approximate linearly the relationship between the peak-to-peak oscillator forces and the mold friction force, will be described below with respect to FIG. 6. In FIG. 6, components identical to those in the first embodiment are numbered in the same way. A total load signal representing the sum of the signals generated at the load cells (which may, for example, be two in number) located beneath the mold table, is output by the total load signal generation circuit 10, along line 12 to the static offset extraction circuit 16. The static offset extraction circuit 16 may be a filter, preferably a plurality of filters for removing the static offset component of the total load signal. The static offset component of the total load signal then is output along line 18, and corresponds to the mean oscillator load during casting.

For a given sinusoidal oscillation of a mold table, from one extreme in the oscillator stroke to the other and back again, the maximum and minimum mold friction forces occur at the two midpoints of the stroke. The above-described operation having been performed on the total load signal, the extracted static offset component contains no periodic dynamic component. Consequently, provided the weight of the oscillating table, mold table, frame, and coolant water flowing in the oscillating table and mold are zeroed out of load-cell readings, and provided the value of the mean oscillator load during casting, which corresponds to the mean mold friction force, is appropriately amplified, it is possible to calculate the peak-to-peak and maximum mold friction forces.

FIG. 6 shows how these values are calculated and output. The signal along line 8 passes to first amplifier circuit 90, whose gain depends on oscillator stroke, oscillator cyclic frequency, and casting speed. The output of first amplifier circuit 90 is the peak-to-peak mold friction force $F_{pp}$, which is related to the mean mold friction force $F_m$ as follows:

$$F_{pp} = F_m * 2K \quad (1)$$

$$\text{where } K = \frac{\pi * \text{stroke} * \text{cyclic frequency}}{\text{casting speed}}$$

The signal along line 18 also passes to second amplifier circuit 92, whose gain is related to the gain of first amplifier circuit 90. The output of second amplifier circuit 92 is the maximum mold friction force $F_M$:

$$F_M = F_m * (1 + K) \quad (2)$$

The mean mold friction force is output along line 18 to a display 40, and also to a monitor 42. The peak-to-peak mold friction force is output to a display 43, and also to a monitor 45, the display 43 and the monitor 45 being the same as other monitors and displays described above. Similarly, the maximum mold friction force is output to a display 46 and a monitor 48.

It is generally known to make K a constant during a given casting operation by making the oscillator stroke a present constant, and by making at least the ratio of oscillator cyclic frequency to casting speed a constant.

For a given casting apparatus, the gains of amplifier circuits 90 and 92 may be fixed, or the gains may be adjustable according to casting conditions and different casting apparatuses. Further, while the amplifier circuits 90 and 92 are separately illustrated, by suitably choosing the configuration of the amplifier circuitry, the amplifier circuits 90 and 92 may be combined into a single amplifier circuit with selectable gain for alternately providing both the $F_M$ and the $F_{pp}$ signals.

The above-described second embodiment represents a significant simplification of hardware required to monitor mold friction. All that is necessary is that the total load signal be conditioned; filtered to allow only signal frequencies less than approximately half the minimum oscillator cyclic frequency; and appropriately amplified. Any suitable display, such as a strip chart recorder, may be used to display the monitored values. It should be noted that, if the oscillator stroke is not sinusoidal, or if the oscillator is not operating according to design conditions where the signals from all the load cells are in phase and do not have dynamic perturbations because of system wear and other deficiencies, the performance of the second embodiment may be adversely affected.

While two specific embodiments of the invention have been described above, it should be appreciated that various changes and modifications could be made to the disclosed embodiments without departing from the spirit and scope of the invention. For example, the described embodiments basically are analog systems except for the panel meters and alarms. However, the electronic circuitry described could be equally as well implemented in digital circuitry if desired. Further, not only could the number and type of load cells used in conjunction with this system be varied, but the system would also work with a load signal generated by some means other than load cells, e.g. by the current monitoring circuitry disclosed in the above-cited U.S. Pat. No. 3,893,502 to Slamar.

We claim:

1. A continuous casting apparatus comprising:

a mold for receiving a casting metal;

oscillating means for oscillating said mold;

load signal generating means for generating a load signal having both static and dynamic signal components and representing the load between said mold and said oscillating means; and monitoring means, including dynamic signal generating means for substantially removing said static component from said load signal to obtain a dynamic signal and smoothing means for smoothing said dynamic signal to obtain a substantially DC smoothed signal representing the dynamic component of said load signal.

2. A continuous casting apparatus as defined in claim 1, wherein said dynamic signal generating means comprises:

static offset extraction means responsive to said load signal for generating a static offset signal substantially corresponding to said static component of said load signal; and subtraction means for subtracting said static offset signal from said load signal to obtain said dynamic signal substantially corresponding to the dynamic component of said load signal.

3. A continuous casting apparatus as defined in claim 2, wherein said static offset extraction means comprises at least one active filter.

4. A continuous casting apparatus as defined in claim 2, wherein said monitoring means further comprises:

static reference signal generating means for generating a substantially DC static reference signal corresponding to the static component of a load signal obtained during free-running oscillation of said mold with no casting metal in said mold; and subtraction means for subtracting said static reference signal from said static offset signal.

5. A continuous casting apparatus as defined in claim 4, wherein said static reference signal generating means comprises manually adjustable means for varying the value of said static reference signal.

6. A continuous casting apparatus as defined in claim 4, wherein said static reference signal generating means comprises frequency detection means for detecting the oscillating frequency of said mold and means responsive to said frequency detection means for generating a static reference signal voltage which varies in accordance with the detected frequency.

7. A continuous casting apparatus as defined in claim 1, wherein said monitoring means further comprises:

dynamic reference signal generating means for generating a substantially DC signal corresponding to the dynamic component of a load signal obtained during free-running oscillation of said mold with no casting metal in said mold; and a first subtraction means for subtracting said dynamic reference signal from said smoothed signal to obtain a substantially DC signal representing the dynamic component of friction between said mold and casting metal.

8. A continuous casting apparatus as defined in claim 7, wherein said dynamic reference signal generating means comprises manually-adjustable means for generating a selected one of a plurality of dynamic reference signals.

9. A continuous casting apparatus as defined in claim 7, wherein said dynamic reference signal generating means comprises frequency detection means for detecting the oscillating frequency of said mold, and means responsive to said frequency detection means for generating a dynamic reference signal having a value which varies in accordance with the detected frequency.

10. A continuous casting apparatus as defined in claim 1, wherein said smoothed signal substantially represents the RMS value of said dynamic signal component.

11. A mold friction monitoring device for use in a continuous casting apparatus of the type having a mold for receiving a casting metal, oscillating means for oscillating said mold, and load signal generating means for generating a load signal having both static and dynamic signal components and representing the load between said mold and said oscillating means, said monitoring device comprising:

dynamic signal generating means for substantially removing said static component from said load signal to obtain a dynamic signal; and smoothing means for smoothing said dynamic signal to obtain a substantially DC smoothed signal representing the dynamic component of said load signal.

12. A mold friction monitoring device as defined in claim 11, wherein said dynamic signal generating means comprises:

static offset extraction means responsive to said load signal for generating a static offset signal substantially corresponding to said static component of said load signal; and subtraction means for subtracting said static offset signal from said load signal to obtain said dynamic signal substantially corresponding to the dynamic component of said load signal.

13. A mold friction monitoring device as defined in claim 12, wherein said static offset extraction means comprises at least one active filter.

14. A mold friction monitoring device as defined in claim 12, further comprising:

static reference signal generating means for generating a substantially DC static reference signal corresponding to the static component of a load signal obtained during free-running oscillation of said mold with no casting metal in said mold; and subtraction means for subtracting said static reference signal from said static offset signal.

15. A mold friction monitoring device as defined in claim 14, wherein said static reference signal generating means comprises manually adjustable means for varying the value of said static reference signal.

16. A mold friction monitoring device as defined in claim 14, wherein said static reference signal generating means comprises frequency detection means for detecting the oscillating frequency of said mold and means responsive to said frequency detection means for generating a static reference signal voltage which varies in accordance with the detected frequency.

17. A mold friction monitoring device as defined in claim 11, further comprising:

dynamic reference signal generating means for generating a substantially DC signal corresponding to the dynamic component of a load signal obtained during free-running oscillation of said mold with no casting metal in said mold; and subtraction means for subtracting said dynamic reference signal from said smoothed signal to obtain a substantially DC signal representing the dynamic component of friction between said mold casting metal.

18. A mold friction monitoring device as defined in claim 17, wherein said dynamic reference signal generating means comprises manually-adjustable means for generating a selected one of a plurality of dynamic reference signals.

19. A mold friction monitoring device as defined in claim 17, wherein said dynamic reference signal generating means comprises frequency detection means for detecting the oscillating frequency of said mold, and means responsive to said frequency detection means for generating a dynamic reference signal having a value which varies in accordance with the detected frequency.

20. A mold friction monitoring device as defined in claim 11, wherein said smoothed signal substantially represents the RMS value of said dynamic signal component.

21. A method of monitoring friction between a mold and a casting metal, in a continuous casting apparatus of the type having a mold for receiving said casting metal, oscillating means for oscillating said mold, and load signal generating means for generating a load signal having static and dynamic components and representing the load between said mold and said oscillating means, said method comprising the steps of:

removing said static component from said load signal to obtain a dynamic signal;

smoothing said dynamic signal to obtain a substantially DC smoothed signal representing the dynamic component of said load signal;

generating a first reference signal comprising a substantially DC signal corresponding to the dynamic component of a load signal obtained during free-running oscillation of said mold with no casting metal in said mold; and subtracting said first reference signal from said smoothed signal to obtain a substantially DC signal representing the dynamic component of friction between said mold and casting metal.

22. A method as defined in claim 21, wherein said removing step comprises:

filtering said load signal to obtain a static offset signal substantially corresponding to said static component of said signal; and subtracting said static offset signal from said load signal to obtain said dynamic signal.

23. A method as defined in claim 22, further comprising the steps of:

generating a substantially DC static reference signal corresponding to the static component of a load signal obtained during free-running oscillation of said mold with no casting metal in said mold; and subtracting said static reference signal from said static offset signal.

24. A method as defined in claim 23, wherein said step of generating said static reference signal comprises generating as said static reference signal a voltage having a value which varies in accordance with the oscillating frequency of said mold.

25. A method as defined in claim 21, wherein said generating step comprises generating as said first reference signal a voltage having a value which varies in accordance with the oscillating frequency of said mold.

26. A method as defined in claim 21, wherein said step of smoothing said dynamic signal comprises generating a substantially DC signal corresponding to the RMS value of said dynamic signal.

27. A continuous casting apparatus comprising:

a mold for receiving a casting metal;

oscillating means for oscillating said mold;

load signal generating means for generating a load signal having both static and dynamic signal components and representing the load between said mold and said oscillating means;

means for selecting one of said static and dynamic components of said load signal; and means responsive to said selected load signal component for generating a signal representing friction between said mold and said casting metal.

28. A continuous casting apparatus as defined in claim 27, further comprising monitoring means, including static signal means for substantially removing said static component from said load signal to obtain a static offset signal substantially corresponding to said static component of said load signal, said static offset signal substantially corresponding to mean mold friction force $F_m$.

29. A continuous casting apparatus as defined in claim 28, further comprising amplifier means for amplifying said static offset signal by a first amount related to stroke length and cyclic frequency of said oscillating means, and in accordance with casting speed of said continuous casting apparatus, to obtain a first signal substantially corresponding to peak-to-peak mold friction force $F_{pp}$.

30. A continuous casting apparatus as defined in claim 29, said amplifier means amplifying said static offset signal by a second amount, related to said first amount, to obtain a second signal substantially corresponding to maximum mold friction force $F_M$.

31. A continuous casting apparatus as defined to claim 30, said amplifier means comprising at least two amplifiers for outputting said first and second signals.

32. A continuous casting apparatus as defined in claim 30, said first and second amounts being fixed.

33. A continuous casting apparatus as defined in claim 30, said first and second amounts being adjustable.

34. A continuous casting apparatus as defined in claim 30, wherein $$F_{pp} = F_m * 2K,$$

$$\text{where } K = \frac{\pi * \text{stroke length} * \text{cyclic frequency}}{\text{casting speed}}$$

35. A continuous casting apparatus as defined in claim 30, wherein $$F_M = F_m * (1 + K),$$

$$\text{where } K = \frac{\pi * \text{stroke length} * \text{cyclic frequency}}{\text{casting speed}}$$

36. A method of monitoring fraction between a mold and a casting metal, in a continuous casting apparatus of the type having a mold for receiving said casting metal, oscillating means for oscillating said mold, and mean load signal generating means for generating a mean load signal representing the mean load between said mold and said oscillating means, said method comprising the steps of:

monitoring said mean load signal; and processing said mean load signal to obtain a signal representing at least a portion of said friction.

37. A method as defined in claim 36, wherein said mean load signal comprises at least a portion of a load signal having static and dynamic components.

38. A method as defined in claim 36, wherein said processing step comprises the step of amplifying said mean load signal by a first linear function of K, where K is a predetermined constant.

39. A method as defined in claim 38, wherein said amplifying step further comprises the step of amplifying said mean load signal by a second linear function of K.

40. A method as defined in claim 39, wherein K is determined in accordance with at least one of a group of operating parameters of said continuous casting apparatus.

41. A method as defined in claim 40, wherein said operating parameters include stroke length and cyclic frequency of said oscillating means, and casting speed of said continuous casting apparatus.

42. A method as defined in claim 41, wherein $$K = \frac{\pi * \text{stroke length} * \text{cyclic frequency}}{\text{casting speed}}$$

43. A method as defined in claim 42, wherein said first linear function of K is 2K.

44. A method as defined in claim 42, wherein said second linear function of K is 1+K.

45. A mold friction monitoring device for use in a continuous casting apparatus of the type having a mold for receiving a casting metal, oscillating means for oscillating said mold, and load signal generating means for generating a load signal having both static and dynamic signal components and representing the load between said mold and said oscillating means, said monitoring device comprising:

means for distinguishing between said static and dynamic components of said load signal; and static signal generating means for substantially removing said static component from said load signal to obtain a static offset signal substantially corresponding to said static component of said load signal, said static offset signal substantially corresponding to mean mold friction force $F_m$.

46. A mold friction monitoring device as defined in claim 45, further comprising amplifier means for amplifying said static offset signal by a first amount related to stroke length and cyclic frequency of said oscillating means, and in accordance with casting speed of said continuous casting apparatus, to obtain a first signal substantially corresponding to peak-to-peak mold friction force $F_{pp}$.

47. A mold friction monitoring device as defined in claim 46, said amplifier means amplifying said static offset signal by a second amount, related to said first amount, to obtain a second signal substantially corresponding to maximum mold friction froce $F_M$.

48. A mold friction monitoring device as defined in claim 47, said amplifier means comprising at least two amplifiers for outputting said first and second signals.

49. A mold friction monitoring device as defined in claim 47, said first and second amounts being fixed.

50. A mold friction monitoring device as defined in claim 47, said first and second amounts being adjustable.

51. A mold friction monitoring device as defined in claim 47, wherein $$F_{pp} = F_m * 2K,$$

$$\text{where } K = \frac{\pi * \text{stroke length} * \text{cyclic frequency}}{\text{casting speed}}$$

52. A mold friction monitoring device as defined in claim 47, wherein $$F_M = F_m * (1 + K),$$

$$\text{where } K = \frac{\pi * \text{stroke length} * \text{cyclic frequency}}{\text{casting speed}}$$

* * * * *